US007168262B2

(12) United States Patent
Hirano et al.

(10) Patent No.: US 7,168,262 B2
(45) Date of Patent: Jan. 30, 2007

(54) ICE MAKING MACHINE

(75) Inventors: Akihiko Hirano, Toyoake (JP); Masao Sanuki, Toyoake (JP); Chiyoshi Toya, Toyoake (JP); Kazuhiro Yoshida, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 140 days.

(21) Appl. No.: 11/087,756

(22) Filed: Mar. 24, 2005

(65) Prior Publication Data

US 2006/0213215 A1 Sep. 28, 2006

(51) Int. Cl.
*F25C 5/10* (2006.01)

(52) U.S. Cl. ..... 62/352

(58) Field of Classification Search ..... 62/73, 62/352

See application file for complete search history.

(56) References Cited

U.S. PATENT DOCUMENTS 4,959,971 A * 10/1990 Minari ..... 62/197
5,218,830 A * 6/1993 Martineau ..... 62/73
5,355,697 A * 10/1994 Morimoto ..... 62/278
5,937,658 A * 8/1999 Black et al. ..... 62/73
6,145,324 A * 11/2000 Dolezal ..... 62/73
6,196,007 B1 3/2001 Schlosser et al.
6,681,580 B1 * 1/2004 Shedivy et al. ..... 62/73
6,705,107 B1 3/2004 Schlosser et al.
7,017,353 B1 * 3/2006 Gist et al. ..... 62/73
2002/0078705 A1 6/2002 Schlosser et al.

FOREIGN PATENT DOCUMENTS

JP 2000-213841 8/2000
JP 2004-92929 A * 3/2004
JP 2004-92930 A * 3/2004

* cited by examiner

*Primary Examiner*—William E. Tapolcai
(74) *Attorney, Agent, or Firm*—Wenderoth, Lind & Ponack, L.L.P.

(57) ABSTRACT

In external unit 19, three-way valve 25 provided downstream of CPR 23 enables a switching connection between CPR 23 and branch line 21A of first bypass line 21 with respect to liquid line 18 A. In internal unit 20, second bypass line 27 connects inlet side of receiver 13 and inlet side of evaporator 16, and open/close valve 28 is provided along second bypass line 27. At de-icing, three-way valve 25 switches to first bypass line 21 side and open/close valve 28 opens. There upon, hot gas from compressor 11 circulates from first bypass line 21 to liquid line 18A to enter evaporator 16 through second bypass line 27 while squeezing out liquid refrigerant. Evaporator 16 is heated by manifest heat of introduced hot gas, and when the internal pressure of vaporator 16 rises to a condensation temperature over 0° C., de-icing is performed efficiently by manifest heat plus latent heat.

17 Claims, 11 Drawing Sheets

Prior Art

ICE MAKING MACHINE

BACKGROUND OF THE INVENTION

1. Field of the Invention

The present invention relates to an ice making machine for making ice by means of a cooling function of an evaporator in a refrigeration circuit and accomplishing de-icing through a rise in temperature of the evaporator.

2. Description of the Prior Art

As one example of a conventional kind of ice making machine, the machine disclosed in Japanese Patent Laid-Open No. 2000-213841 is known. As shown in FIG. 11, in this machine a compressor 1, a condenser 2, a receiver 3, a dryer 4, an expansion valve 5, an evaporator 6, and an accumulator 7 (i.e., a liquid separator), are connected in a circulatory manner by refrigerant piping. Of these components the compressor 1, the condenser 2, and the accumulator 7, are disposed in an external unit, and the remaining components are disposed in an internal unit. On the outlet side of the condenser 2 is disposed a condensing pressure regulating valve 8 (CPR) to allow the flow of hot gas from the compressor 1 to the receiver 3 through a bypass line 1A. Further, characteristically, a gas outlet 3A is provided at the receiver 3. This gas outlet 3A is connected to an inlet of the evaporator 6 by a gas line 9 that is provided with a valve 9A partway along the gas line 9.

The operation of this conventional example is as follows. At the time of ice making, as known in the art, ice is formed by a refrigerating action imparted to latent heat (i.e., an endothermic action). The refrigerating action is generated when liquid refrigerant is vaporized inside the evaporator 6.

In contrast, at the time of de-icing, when the valve 9A of the gas line 9 is opened, low-temperature refrigerant gas inside the receiver 3 is introduced into the evaporator 6. The evaporator 6 is heated to conduct de-icing by latent heat produced when this gas condenses (i.e., an exothermic action). At the same time, because the pressure on the high pressure side decreases, the CPR 8 operates so that hot gas from the compressor 1 is supplied to the receiver 3 through the bypass line 1A to promote vaporization of the liquid refrigerant inside the receiver 3, whereby more refrigerant gas is introduced into the evaporator 6 to continue the de-icing.

The fundamental function of the CPR 8 in the refrigeration cycle described above is as follows. For example, in a case such as in wintertime when the outdoor air temperature is low and the cooling capacity of the condenser 2 has become excessively high, when the pressure on the high pressure side of the compressor 1 drops to a predetermined value the CPR 8 is activated to allow hot gas from the compressor 1 to flow to the side of the receiver 3, to thereby accumulate liquid refrigerant in the condenser 2 and reduce the cooling capacity. Naturally, in a case such as in summertime when the outdoor air temperature is high, the CPR 8 exerts the maximum cooling capacity by, conversely, closing the channel on the side of the bypass line 1A to allow high-temperature, high-pressure refrigerant from the compressor 1 to flow into the condenser 2.

However, when this refrigeration cycle is assessed with respect to its de-icing function, the following problem emerges. That is, when the outside air temperature is not remarkably high, there is no problem with the de-icing performance because hot gas from the compressor 1 is supplied to the receiver 3 through the bypass line 1A by the above-described action of the CPR 8. However, when the outside air temperature is high, the hot gas from the compressor 1 is fed to the receiver 3 after being cooled in the condenser 2, thus causing a decrease in the de-icing performance.

SUMMARY OF THE INVENTION

According to this invention, there is provided an ice making machine that includes a bypass line and a valve device that enable hot gas from the compressor to be supplied to the evaporator by bypassing the condenser. Therefore the hot gas is not cooled in the condenser, even when the outside air temperature is high. Thus, efficient and stable de-icing operations can be performed regardless of the operating conditions such as the outside air temperature.

DETAILED DESCRIPTION OF THE PREFERRED EMBODIMENTS

Hereunder, embodiments of the present invention are described based on the attached drawings.

<Embodiment 1>

Figure 1:
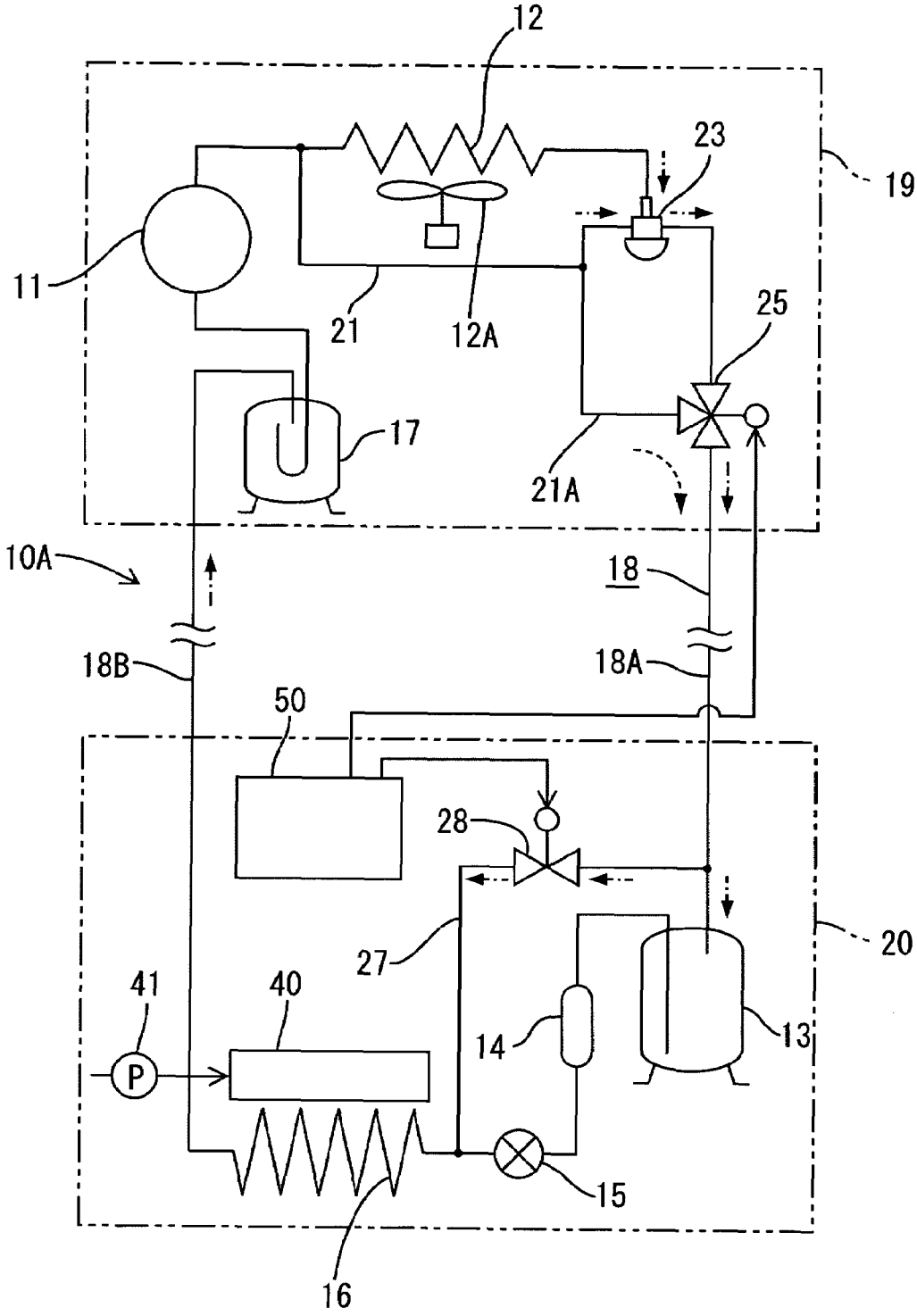
FIG. 1 is a circuit diagram of the refrigeration circuit of the first embodiment of this invention.
Figure 2:
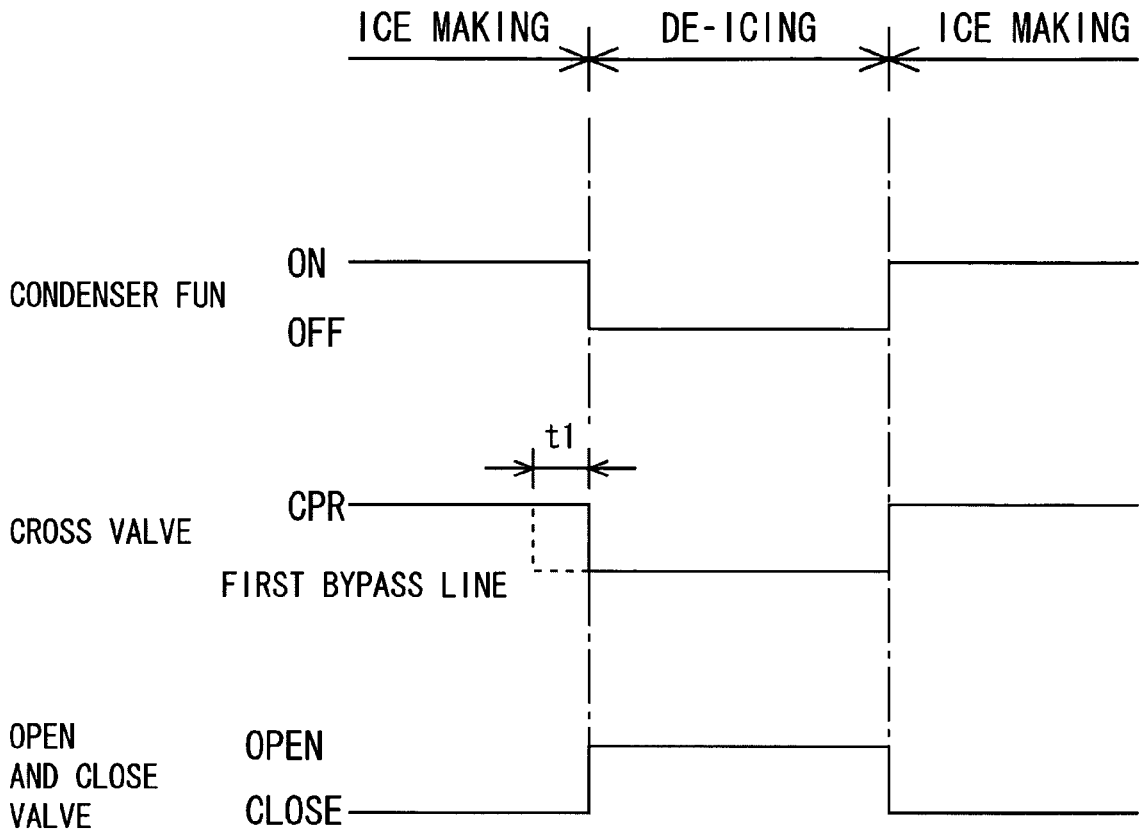
FIG. 2 is a timing chart for the refrigeration circuit of the first embodiment.

Embodiment 1 of this invention is described hereafter referring to FIG. 1 and FIG. 2. In a cooling system 10A of Embodiment 1, a compressor 11, a condenser 12 with a condenser fan 12A, a receiver 13, a dryer 14, an expansion valve 15, an evaporator 16, and an accumulator 17 (i.e., liquid separator), are connected in a circulatory manner by refrigerant piping 18 that includes a refrigerant supply line 18A and a refrigerant return line 18B. Of these components, the compressor 11, condenser 12, and accumulator 17, are disposed in an external unit 19, and the remaining components are disposed in an internal unit 20. On the outlet side of the condenser 12 a condensing pressure regulating valve 23 (CPR) is disposed at a position between the condenser 12 and the receiver 13. The condensing pressure regulating valve 23 has two inlets and one outlet. One of the inlets is connected with an outlet of the condenser 12. The other inlet is connected to a first bypass line 21 that leads from the compressor 11. The outlet is connected to an inlet of the receiver 13. Further, the evaporator 16 is disposed such that it cools an ice-forming mold 40. The configuration includes a water supply system that supplies water from a pump 41 to the ice-forming mold 40.

On the side of the external unit 19, a three-way valve 25 that has two inlets and that corresponds to a first valve device is connected to the outlet side of the aforementioned CPR 23. One of the inlets of the three-way valve 25 is connected to the outlet of the condensing pressure regulating valve 23. The other inlet is connected to the first bypass line 21 through a branch line 21A. The outlet of the valve 25 is connected via the line 18A to the receiver 13 that is disposed on the internal unit 20 side.

In the internal unit 20, a second bypass line 27 branches from the refrigerant supply line 18A at a position near the inlet side of the receiver 13 to connect to the inlet side of the evaporator 16. An open/close valve 28 that corresponds to a second valve device is provided partway along the second bypass line 27.

As described later, the three-way valve 25 and the open/close valve 28 are subject to switching control or open/close control by a valve controller 50 in accordance with the timing of an ice making operation and a de-icing operation.

Next, the operation of Embodiment 1 will be described.

As shown in FIG. 2, in the ice making operation, the cooling system 10A (e.g., compressor 11) is driven in a state in which the condenser fan 12A is being driven, the three-way valve 25 is switched to the side of the CPR 23, and the open/close valve 28 is closed. As known in the art, ice is formed in an ice-forming mold 40 in which the evaporator 16 is provided through a refrigerating action produced on the latent heat in the water. The refrigerating action is generated by the evaporation of the liquid refrigerant that was introduced into the evaporator 16 from a liquid outlet of the receiver 13.

When a sensor or the like detects that a predetermined ice making time has lapsed or that a predetermined quantity of ice has been made, the operation switches to a de-icing operation.

Upon entering the de-icing operation, the condenser fan 12A is stopped, the three-way valve 25 switches to the side of the first bypass line 21, and the open/close valve 28 opens. Thereupon, as shown by the arrow with a dashed line in FIG. 1, hot gas from the compressor 11 circulates from the first bypass line 21 to the refrigerant supply line 18A. The hot gas is introduced into the evaporator 16 through the second bypass line 27 while squeezing out the liquid refrigerant in the line 18A. Since liquid refrigerant that was comparatively warm was flowing in the refrigerant supply line 18A during the ice making operation, the hot gas that passed through the refrigerant supply line 18A is introduced into the evaporator 16 without a significant drop in temperature.

When the hot gas is introduced into the evaporator 16, the evaporator 16 is heated by manifest heat because the temperature of the hot gas is sufficiently high in comparison to the ice. When the internal pressure of the evaporator 16 rises to produce a condensation temperature of 0° C. or more, heating is performed by manifest heat plus the latent heat produced by the condensation, thus efficiently carrying out the de-icing. When the de-icing operation finishes, the operation switches again to an ice making operation, and the condenser fan 12A, the three-way valve 25, and the open/close valve 28, switch to their respective opposite states to resume ice making.

As described above, even though the interval between the external unit 19 and the internal unit 20 in Embodiment 1 is of a structure that has piping that comprises 2 pipes (i.e., the refrigerant supply line 18A and the refrigerant return line 18B), because the structure allows hot gas from the compressor 11 to be introduced directly into the evaporator 16 upon entering a de-icing operation, both the manifest heat of the hot gas and the latent heat produced when the hot gas is condensed can be utilized to heat the evaporator 16. Further, since the introduction of the hot gas can be performed in a similar manner regardless of a rise or fall in the ambient temperature of the condenser 12, an efficient and stable de-icing action can be carried out regardless of the operating conditions, such as the outside air temperature for example.

<Embodiment 2>

In Embodiment 2, when switching to a de-icing operation, a time difference is implemented between switching of the three-way valve 25 to the side of the first bypass line 21 and opening of the open/close valve 28. More specifically, as shown by the dashed line in the above-described FIG. 2, after the three-way valve 25 switches to the side of the first bypass line 21, the open/close valve 28 is opened after the lapse of a predetermined delay time ti (e.g., from several tens of seconds to about two minutes). The predetermined delay time t1 is measured utilizing a timer. This means that hot gas is first allowed to flow into the refrigerant supply line 18A to collect the liquid refrigerant within the line 18A in the receiver 13. Thereafter, the open/close valve 28 is opened. Thus, since only hot gas is introduced into the evaporator 16 in the de-icing operation without introducing liquid refrigerant therein, when the liquid refrigerant inside the refrigerant supply line 18A is of a low temperature, more efficient de-icing can be carried out in comparison to a case in which the three-way valve 25 and the open/close valve 28 are switched simultaneously.

<Embodiment 3>

In this embodiment, the above Embodiment 2 is further developed. While there is a general tendency to consider it disadvantageous for a de-icing operation to introduce the liquid refrigerant remaining in the refrigerant supply line 18A into the evaporator 16 when commencing a de-icing operation, it has been confirmed that, on the contrary, when the temperature of that liquid refrigerant is high the de-icing performance is enhanced. This is thought to be due to the superior heat transfer properties of liquid as compared to those of gas. Alternatively however, when the temperature of the liquid refrigerant is low the liquid refrigerant results in a weakening of the effect of the hot gas.

Figure 3:
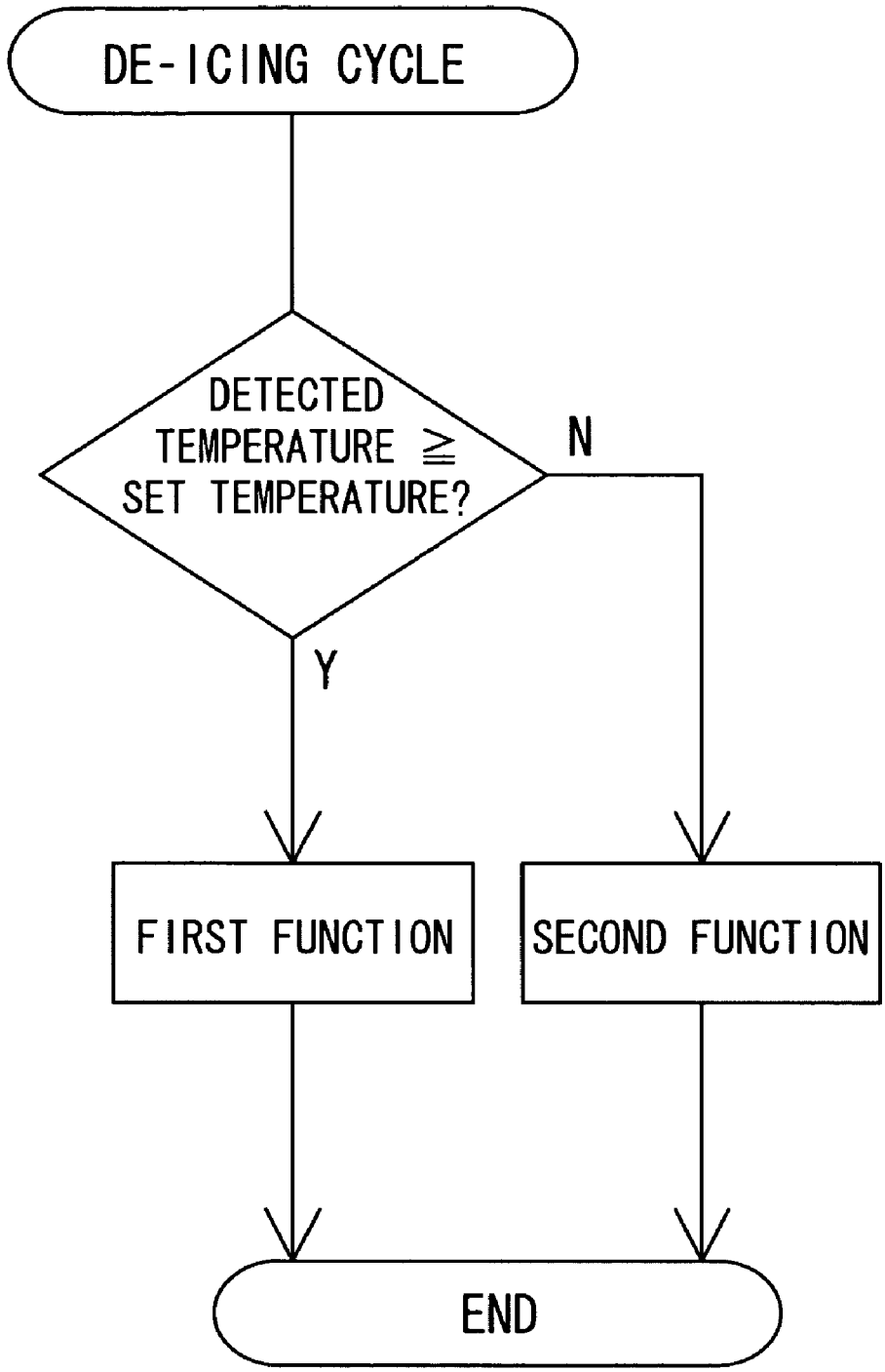
FIG. 3 is a flowchart that illustrates the operation of the third embodiment of this invention.

Therefore, a temperature sensor (not shown in the figure) is provided that detects the ambient temperature of the external unit 19 to thereby detect the temperature of the liquid refrigerant remaining inside the refrigerant supply line 18A through condensation. Thus, as shown in FIG. 3, when the temperature detected by the temperature sensor is equal to or greater than a predetermined setting temperature when entering a de-icing operation, as described in the above Embodiment 1, the valve controller 50 carries out control (i.e., a first function) such that the open/close valve 28 opens simultaneously with switching of the three-way valve 25 to the side of the first bypass line 21. In contrast, when the temperature detected by the temperature sensor is less than the setting temperature, as described in the above Embodiment 2, the valve controller 50 carries out control (i.e., a second function) such that after the three-way valve 25 has switched to the side of the first bypass line 21, the open/close valve 28 is opened after the lapse of a delay time t1.

When the temperature of liquid refrigerant remaining in the refrigerant supply line 18A is high, the liquid refrigerant is introduced into the evaporator 16 to actively utilize the liquid refrigerant for de-icing. By contrast, when the temperature of the liquid refrigerant is low, the liquid refrigerant is not introduced into the evaporator 16 and de-icing can be conducted effectively using only the hot gas. In this connection, the temperature sensor need not necessarily detect the ambient temperature of the external unit 19, and may be provided such that it detects the temperature of a part that changes correspondingly to the temperature of the liquid refrigerant within the refrigerant supply line 18A (i.e., indirectly detects the temperature).

<MODIFICATION EXAMPLES>

Figure 4:
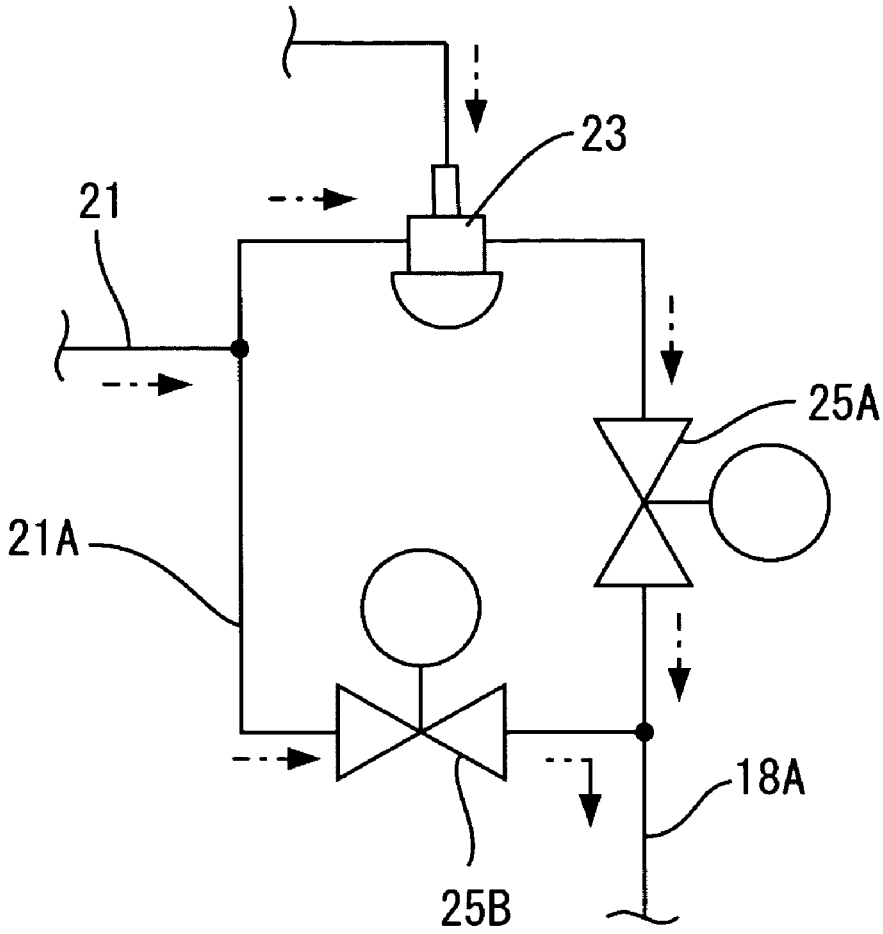
FIG. 4 is a partial circuit diagram showing a modification example of a valve mechanism.

As the first valve device of this invention, instead of the single three-way valve 25 exemplified in the above Embodiments 1 to 3, for example two open/close valves 25A and 25B, which can be individually subjected to open/close control, may be respectively provided on the outlet side of the CPR 23 and on the branch line 21A of the first bypass line 21, as shown in FIG. 4.

Further, while the configuration adopted in the above Embodiments 1 to 3 is one in which the condenser fan 12A stops at the time of a de-icing operation, a configuration may be adopted in which the condenser fan 12A continues to be driven even during the de-icing operation.

<Embodiment 4>

Embodiment 4 of this invention will now be described referring to FIG. 5 and FIG. 6. In this embodiment, an improvement is made to the structure of the section that is provided so that liquid refrigerant is not introduced into the evaporator 16 in a de-icing operation and only hot gas is introduced therein.

Figure 5:
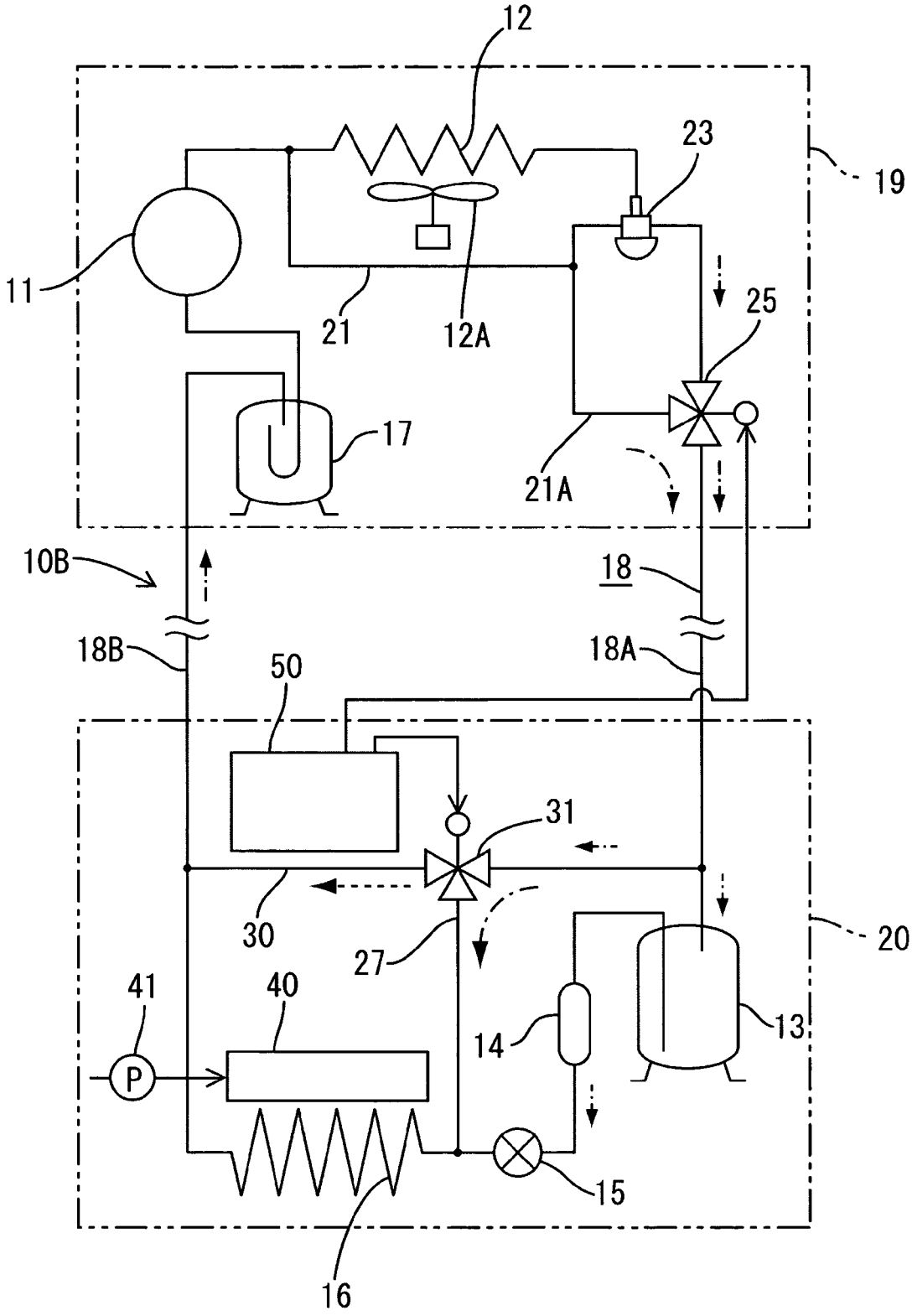
FIG. 5 is a circuit diagram of the refrigeration circuit of the fourth embodiment of this invention.

In a cooling system 10B of Embodiment 4 as shown in FIG. 5, in comparison to the structure of the cooling system 10A (FIG. 1) of the above Embodiment 1, an auxiliary line 30 is branched from partway along the second bypass line 27. The second bypass line 27 is provided between the inlet side of the receiver 13 and the inlet side of the evaporator 16. This auxiliary line 30 is connected to the refrigerant return line 18B. The refrigerant return line 18B connects the evaporator 16 located on the side of the internal unit 20 to the accumulator 17 located on the side of the external unit 19. At the aforementioned branching part is provided a three-way valve 31 with a shut-off function (i.e., an internal side three-way valve).

Since the remaining structure of the cooling system 10B is the same as the example shown in FIG. 1, and parts that have the same function are denoted by the same symbols, duplicate description is omitted herein.

The action of Embodiment 4 is described hereunder. As shown in FIG. 6, an ice making operation is conducted when the cooling system 10B (e.g., the compressor 11) is driven in a state in which the condenser fan 12A is driven and the three-way valve 25 on the external side is switched to the side of the CPR 23. Further, the internal side three-way valve 31 is closed.

When entering a de-icing operation, the condenser fan 12A is stopped and the three-way valve 25 on the external side switches to the side of the first bypass line 21. Simultaneously the internal side three-way valve 31 opens to the side of the auxiliary line 30. Thereupon, as shown by an arrow with a dashed line in FIG. 5, hot gas from the compressor 11 circulates from the first bypass line 21 to the refrigerant supply line 18A to squeeze out liquid refrigerant in the line 18A. Whereby, as shown by the alternate long and short dash line in FIG. 5, the liquid refrigerant passes from the auxiliary line 30 through the gas line 18B to be collected in the accumulator 17.

Figure 6:
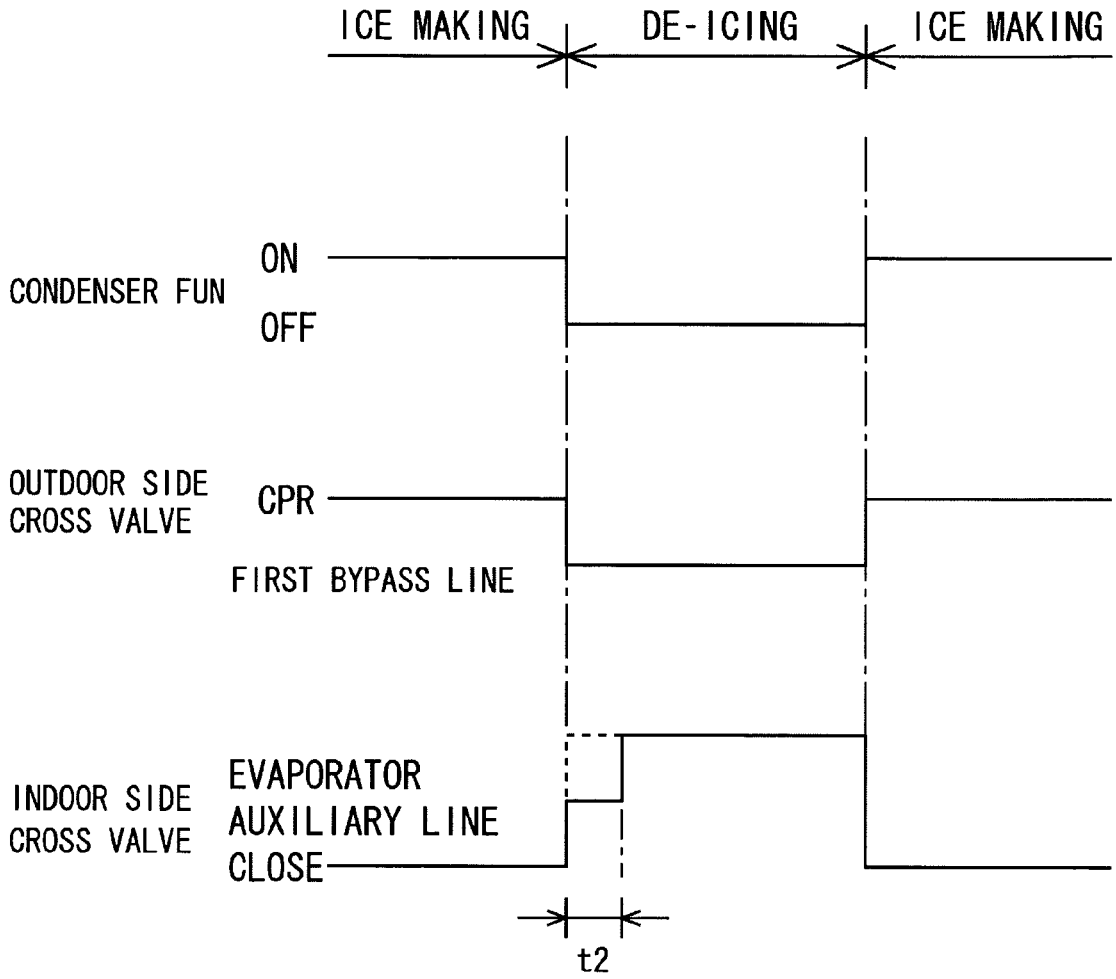
FIG. 6 is a timing chart for the refrigeration circuit of the fourth embodiment.

As shown by a solid line in FIG. 6, when a predetermined delay time t2 lapses (e.g., from several seconds to several tens of seconds), the internal side three-way valve 31 opens to the side of the evaporator 16, whereby hot gas is introduced into the evaporator 16 to conduct de-icing.

<Embodiment 5>

In Embodiment 5, when the temperature of the liquid refrigerant remaining in the refrigerant supply line 18A is relatively high in the cooling system 10B of FIG. 5, as described above in Embodiment 3, the liquid refrigerant is introduced into the evaporator 16 to actively utilize the liquid refrigerant for de-icing. Conversely, when the temperature of the liquid refrigerant is relatively low, the liquid refrigerant is not introduced into the evaporator 16 and de-icing is conducted effectively only using hot gas.

More specifically, when the ambient temperature of the external unit 19 is equal to or greater than a predetermined setting temperature when entering a de-icing operation, the three-way valve 25 on the external side is switched to the side of the first bypass line 21 and simultaneously the internal side three-way valve 31 opens to the side of the evaporator 16, as shown by a dashed line in FIG. 6. Liquid refrigerant that is squeezed out from the refrigerant supply line 18A is introduced into the evaporator 16 together with hot gas.

In contrast, when the ambient temperature of the external unit 19 is less than the setting temperature, as described above in Embodiment 4, the internal side three-way valve 31 is initially opened to the side of the auxiliary line 30, in order to cause the liquid refrigerant to be collected in the accumulator 17. After the delay time t2 has lapsed, the internal side three-way valve 31 opens to the side of the evaporator 16, whereby hot gas is introduced into the evaporator 16 for de-icing.

<MODIFICATION EXAMPLES>

For the internal side three-way valve 31 with a shut-off function that is exemplified in Embodiments 4 and 5 above, the timing for switching from a closed state to opening to the auxiliary line 30 may be set to precede the entry into a de-icing operation by the amount of the delay time t2.

Figure 7:
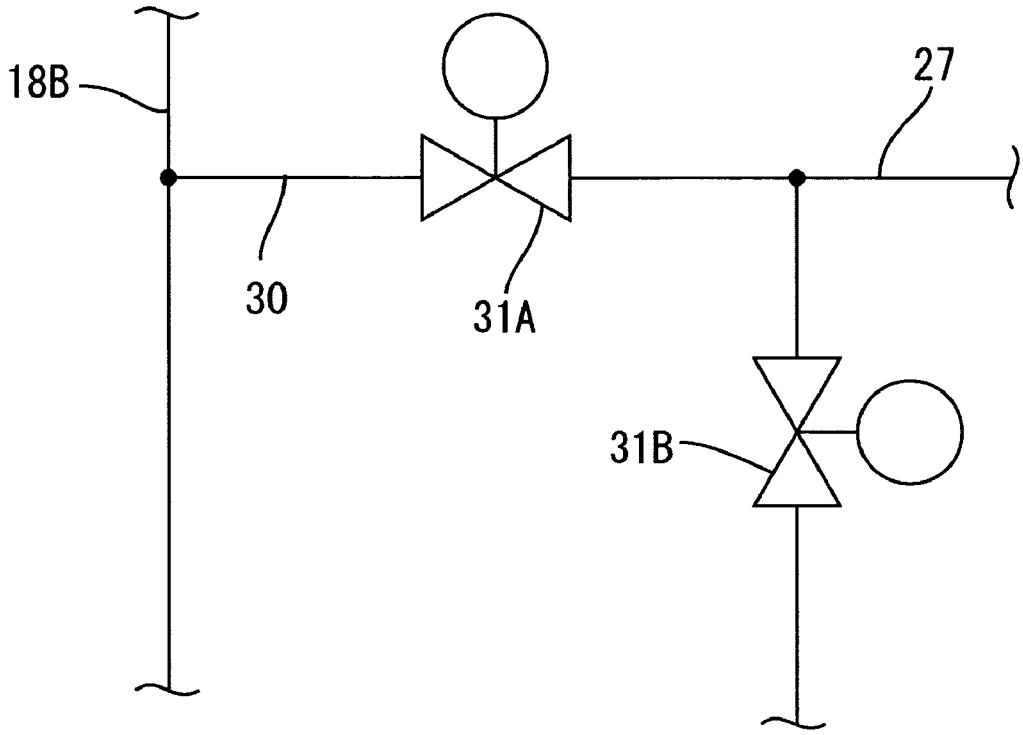
FIG. 7 is a partial circuit diagram showing a modification example of a valve mechanism.

Further, in place of the internal side three-way valve 31 with a shut-off function, two open/close valves 31A and 31B, for example, as shown in FIG. 7 and that can be individually subjected to open/close control, may be respectively provided at a position on the auxiliary line 30 that branches from the second bypass line 27 and a position on the evaporator 16 side of the branching position.

Also, in the above Embodiments 4 and 5, a configuration may be adopted in which the condenser fan 12A continues to be driven even during the de-icing operation.

<Embodiment 6>

Figure 8:
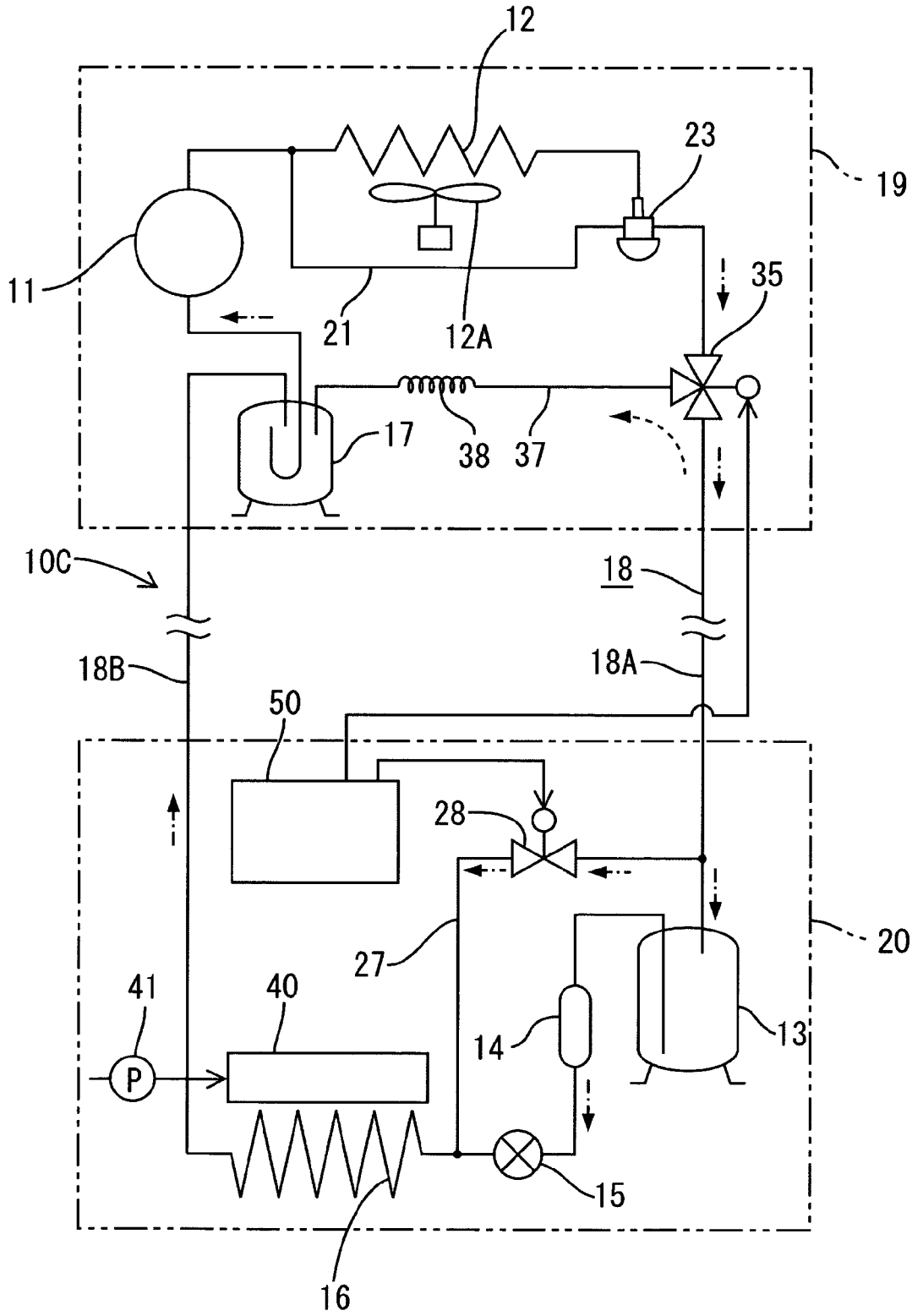
FIG. 8 is a circuit diagram of the refrigeration circuit of the sixth embodiment of this invention.
Figure 9:
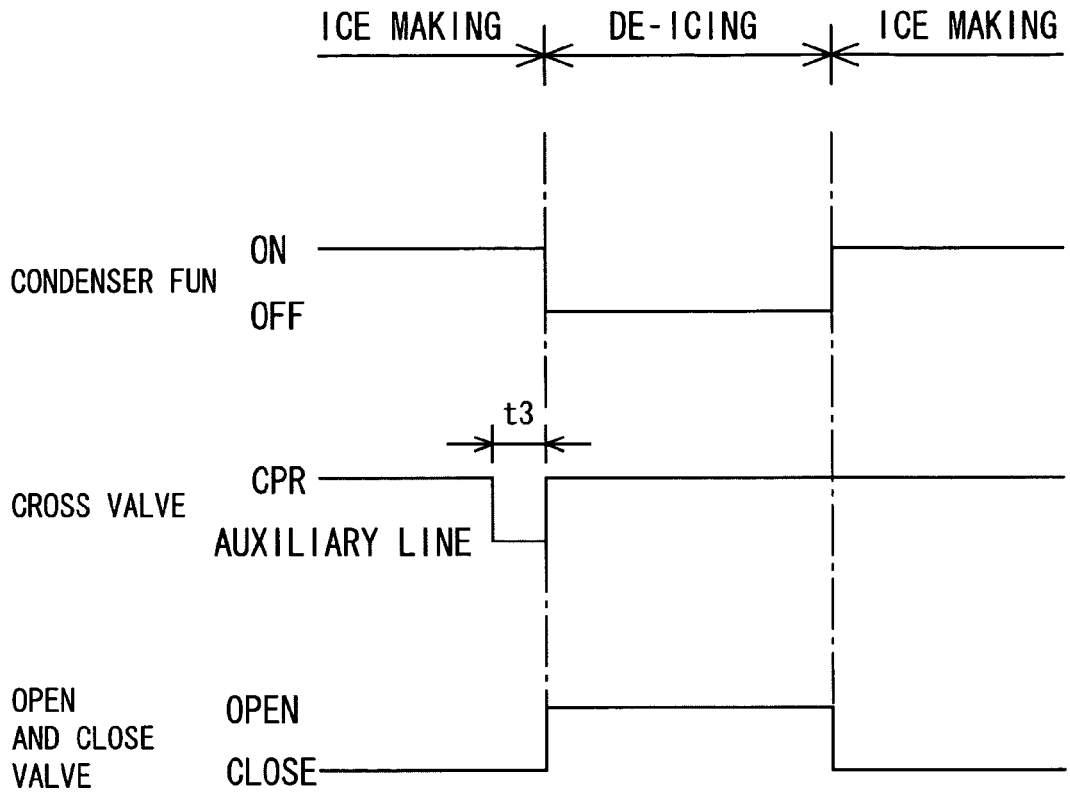
FIG. 9 is a timing chart for the refrigeration circuit of the sixth embodiment.

FIG. 8 and FIG. 9 show Embodiment 6 of this invention. In a cooling system 10C of Embodiment 6 as shown in FIG. 8, in comparison to the structure of the cooling system 10A (FIG. 1) of the above Embodiment 1, in the external unit 19 the branch line 21A from the first bypass line 21 is not provided. The outlet of the condensing pressure regulating valve 23 is connected to a first port of a three-way valve 35 that is provided on the downstream side of the CPR 23. A refrigerant supply line 18 is connected to a second port of the three-way valve 35. And an auxiliary line 37 is connected to a third port of the three-way valve 35. The auxiliary line 37 links to the inside of the accumulator 17. A restrictor 38 is provided partway along the auxiliary line 37. The three-way valve 35 corresponds to the first valve device. The three-way valve 35 is capable of switching between a state in which the first and the second port communicate and a state in which the second and third port communicate.

Since the remaining structure is the same as the example shown in FIG. 1, and parts that have the same function are denoted by the same symbols, duplicate description thereof is omitted herein.

The action of Embodiment 6 is described hereunder. As shown in FIG. 9, an ice making operation is conducted when the cooling system 10C (e.g., the compressor 11) is driven in a state in which the condenser fan 12A is driven and the three-way valve 35 is connected to the side of the CPR 23. Further, the open/close valve 28 is closed.

When the final stage of the ice making operation is reached, more specifically, when a timing is reached that precedes the starting time for a de-icing operation by a predetermined delay time t3 (e.g., from several seconds to several tens of seconds), the three-way valve 35 switches to the side of the auxiliary line 37 based on a signal from the valve controller 50. As shown by an arrow with a dashed line in FIG. 8, as the result of a pressure differential the liquid refrigerant that remains inside the refrigerant supply line 18A passes through the auxiliary line 37 to be collected in the accumulator 17. In this case, the reason for providing the restrictor 38 in the auxiliary line 37 is that if high-pressure liquid refrigerant were allowed to flow unrestricted to the side of the accumulator 17, the low-pressure side would rise too much and affect the ice making operation.

After the delay time t3 lapses the de-icing operation begins, whereby the condenser fan 12A is stopped. The three-way valve 35 switches again to the side of the CPR 23. And, the open/close valve 28 opens. Thus, hot gas from the CPR 23 is introduced into the evaporator 16 through the refrigerant supply line 18A and the second bypass line 27 in order to conduct de-icing.

In this embodiment, because hot gas from the CPR 23 is introduced directly into the evaporator 16 when a de-icing operation has begun, de-icing can be conducted quicker than in the conventional configuration in which hot gas from a CPR is introduced into a receiver to vaporize liquid refrigerant contained therein, and the resulting low-temperature refrigerant gas is then introduced into an evaporator. In addition, depending on conditions such as the outside air temperature, hot gas of a comparatively high temperature can be introduced into the evaporator. Thereby de-icing by manifest heat can also be expected, enhancing the de-icing effect.

Further, in the de-icing operation, when it is desired to conduct de-icing using only hot gas without causing the liquid refrigerant that remains in the refrigerant supply line 18A to be introduced into the evaporator 16, since the configuration is such that liquid refrigerant remaining in the refrigerant supply line 18A is collected in the accumulator 17 through the auxiliary line 37 that is provided in the external unit 19, the collection can be carried out quickly and with a simple structure.

<Embodiment 7>

In Embodiment 7, when the temperature of liquid refrigerant remaining in the refrigerant supply line 18A is relatively high in the cooling system 10C of FIG. 8, as described above in Embodiment 3, the liquid refrigerant is introduced into the evaporator 16 to actively utilize the liquid refrigerant for de-icing. Conversely, when the temperature of the liquid refrigerant is relatively low, de-icing is conducted only using hot gas without introducing liquid refrigerant into the evaporator 16.

More specifically, when the ambient temperature of the external unit 19 is equal to or greater than a predetermined setting temperature upon entering a de-icing operation, hot gas is introduced into the evaporator 16 together with liquid refrigerant that was squeezed out from the refrigerant supply line 18A. This occurs when the open/close valve 28 is opened while the three-way valve 35 is connected to the side of the CPR 23.

In contrast, when the ambient temperature is less than the setting temperature, as exemplified in the above Embodiment 6, the three-way valve 35 is initially opened to the side of the auxiliary line 37, causing the liquid refrigerant to be collected in the accumulator 17. After a delay time t3 has lapsed, the three-way valve 35 is connected to the side of the CPR 23 and the open/close valve 28 is opened to allow hot gas to be introduced into the evaporator 16 for de-icing.

MODIFICATION EXAMPLES

Figure 10:
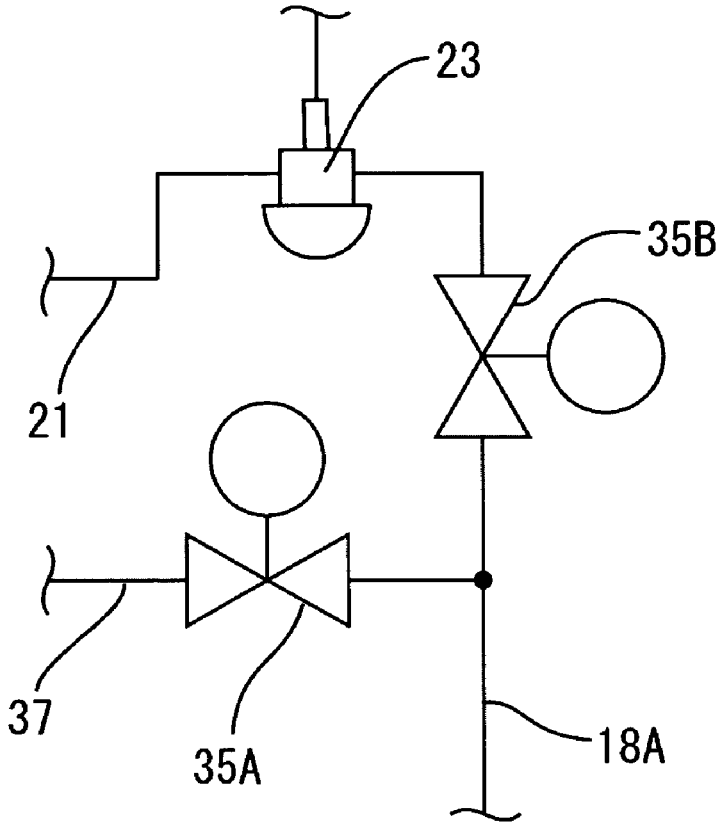
FIG. 10 is a partial circuit diagram showing a modification example of a valve mechanism.
Figure 11:
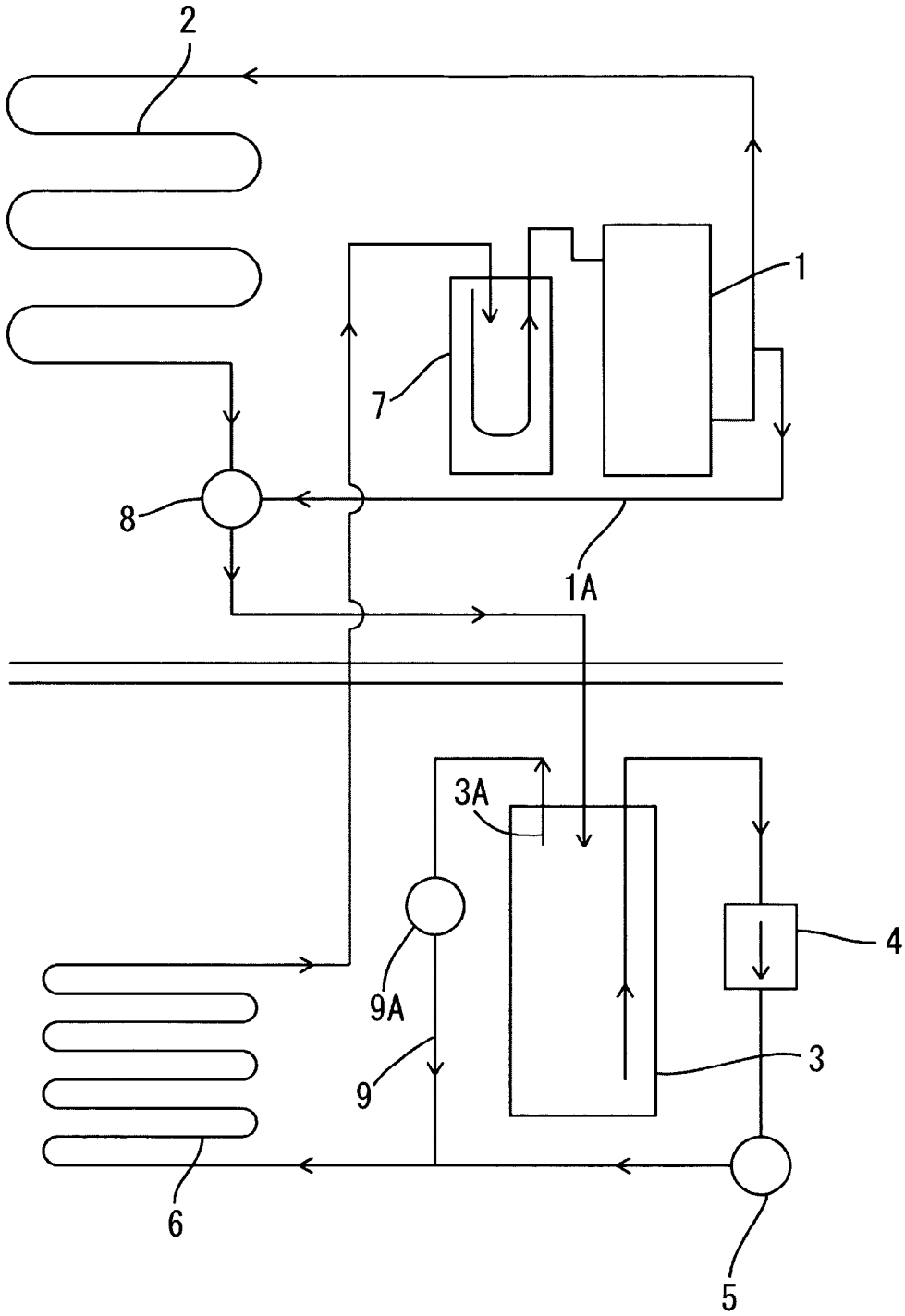
FIG. 11 is a schematic view illustrating the circuitry of a conventional example.

Instead of the three-way valve 35 exemplified in the above Embodiments 6 and 7, for example, as shown in FIG. 10, two open/close valves 35A and 35B, which can be individually subjected to open/close control, may be respectively provided at a position on the auxiliary line 37 that branches from the refrigerant supply line 18A and connects to the accumulator 17, and a position on the CPR 23 side of the branching position.

For Embodiments 6 and 7 also, a configuration may be adopted in which the condenser fan 12A continues to be driven during the de-icing operation.

In the following claims, connecting can mean either directly connecting two elements or indirectly connecting two or more elements.

What is claimed is:

1. An ice making machine comprising:

(A) a water supply system including an ice-forming mold; and (B) a cooling system including:

a compressor that compresses a refrigerant;

a condenser that cools the refrigerant that was compressed by the compressor;

a condensing pressure regulating valve comprising two inlets and one outlet, wherein one of the inlets is connected to an outlet side of the condenser;

a first bypass line connecting the other inlet of the condensing pressure regulating valve and an outlet side of the compressor;

a first valve device comprising two inlets and one outlet, wherein one of the inlets is connected with the outlet side of the condensing pressure regulating valve, and the other inlet is connected to the outlet side of the compressor;

a receiver that connects to an outlet side of the first valve device via a refrigerant supply line;

an expansion valve that connects to a liquid outlet side of the receiver;

an evaporator that connects to an outlet side of the expansion valve and cools the ice-forming mold;

a second bypass line comprising a second valve device, wherein the second bypass line connects between the refrigerant supply line and an inlet side of the evaporator by bypassing the expansion valve;

a refrigerant return line that connects an outlet side of the evaporator and an inlet side of the compressor; and a valve controller that controls the first valve device and the second valve device and comprises:

a ice making function wherein during an ice making operation, the first valve device connects the outlet side of the condensing pressure regulating valve with the inlet side of the receiver and the second valve device is closed, and a first function wherein when the ice making machine switches from the ice making function to a de-icing operation, the first valve device connects the compressor outlet side with the refrigerant supply line at substantially the same time as the second valve device is opened.

2. The ice making machine according to claim 1, wherein an inlet side of the second bypass line is provided in a condition in which the inlet side of the second bypass line branches from the refrigerant supply line.

3. The ice making machine according to claim 2, wherein the compressor and the condenser are disposed at a distance from the evaporator, and the receiver is disposed close to the evaporator.

4. The ice making machine according to claim 3, wherein the valve controller further controls the first valve device and the second valve device and further comprises:

a second function wherein at a predetermined delay time prior to the ice making machine switching from the ice-making function to the de-icing operation, the first valve device connects the compressor outlet side with the refrigerant supply line, the second valve device is opened at the start of the de-icing operation.

5. The ice making machine according to claim 3, further provided with a temperature sensor that directly or indirectly detects a temperature corresponding to the refrigerant in a liquid state inside the refrigerant supply line proceeding from the outlet side of the condensing pressure regulating valve towards the inlet side of the receiver, wherein the valve controller further comprises:

wherein when the temperature detected by the temperature sensor is equal to or greater than a predetermined temperature, the valve controller executes the first function, and wherein when the temperature detected by the temperature sensor is lower than the predetermined temperature, the valve controller executes the second function.

6. The ice making machine according to claim 5 wherein the first valve device comprises two two-way valve devices.

7. An ice making machine comprising:

(A) a water supply system including an ice-forming mold; and (B) a cooling system including:

a compressor that compresses a refrigerant;

a condenser that cools the refrigerant that was compressed by the compressor;

a condensing pressure regulating valve comprising two inlets and one outlet, wherein one of the inlets connects to an outlet side of the condenser;

a first bypass line connecting the other inlet of the condensing pressure regulating valve and an outlet side of the compressor;

a first valve device comprising two inlets and one outlet, wherein one of the inlets is connected with the outlet of the condensing pressure regulating valve, and the other inlet is connected to the outlet side of the compressor;

a receiver that is connected to the outlet of the first valve device via a refrigerant supply line;

an expansion valve that is connected to a liquid outlet side of the receiver;

an evaporator that is connected to an outlet side of the expansion valve and cools the ice-forming mold;

a second valve device having one inlet and two outlets and which is capable of switching at least between a state in which the second valve device shuts the inlet with respect to both of the outlets and a state in which the second valve device allows the inlet to communicate with one of the two outlets, wherein the inlet of the second valve device is connected to the refrigerant supply line via a first portion of a second bypass line and wherein one of the outlets bypasses the expansion valve to connect to an inlet side of the evaporator via a second portion of the second bypass line;

a refrigerant return line that is connected to an outlet side of the evaporator;

an accumulator that is connected to the refrigerant return line and is provided between the refrigerant return line and the inlet side of the compressor;

an auxiliary line that connects the other outlet of the second valve device to the refrigerant return line;

a valve controller that controls the first valve device and the second valve device and comprises:

an ice making function wherein the first valve device connects the condensing pressure regulating valve side with the inlet side of the receiver and the second valve device is closed, and a second function wherein at the time of a de-icing operation, the first valve device connects the outlet side of the compressor with the refrigerant supply line, the second valve device initially connects the refrigerant supply line to the refrigerant return line via the first portion of the second bypass line and the auxiliary line, and following a lapse of a predetermined delay time, the second valve device connects the refrigerant supply line to inlet side of the evaporator via the first portion of the second bypass line and the second portion of the second bypass line.

8. The ice making machine according to claim 7, wherein the inlet side of the second valve device branches from the refrigerant supply line via the first portion of the second bypass line.

9. The ice making machine according to claim 8, wherein the compressor and the condenser are disposed at a distance from the evaporator, and the receiver is disposed close to the evaporator.

10. The ice making machine according to claim 9, further provided with a temperature sensor that directly or indirectly detects a temperature corresponding to the refrigerant in a liquid state inside the refrigerant supply line proceeding from the condensing pressure regulating valve towards the receiver side, wherein the valve controller further comprises:

a first function wherein when the ice making machine is switching from the ice making function to the de-icing operation the second valve device connects the refrigerant supply line with the inlet of the evaporator via the first portion of the second bypass line and the second portion of the second bypass line at substantially the same time as the first valve device connects the outlet side of the compressor to the refrigerant supply line, and wherein when a temperature detected by the temperature sensor is equal to or greater than a predetermined temperature, the valve controller executes the first function, and wherein when the temperature detected by the temperature sensor is lower than the predetermined temperature the valve controller executes the second function.

11. The ice making machine according to claim 10, wherein the second valve device comprises two two-way valve devices.

12. The ice making machine according to claim 11, wherein the first valve device comprises two two-way valve devices.

13. The ice making machine according to claim 10, wherein the first valve device comprises two two-way valve devices.

14. An ice making machine comprising:

(A) a water supply system including an ice-forming mold; and (B) a cooling system including:

a compressor that compresses a refrigerant;

a condenser that cools the refrigerant that was compressed by the compressor;

a condensing pressure regulating valve comprising two inlets and one outlet, wherein one of the inlets is connected to an outlet side of the condenser;

a first bypass line connecting between the other inlet of the condensing pressure regulating valve and the outlet side of the compressor;

a first valve device having three ports comprising a first port, a second port, and a third port, wherein the first valve device is capable of switching selectively between a state in which the first port and the second port are allowed to communicate and a state in which the second and the third port are allowed to communicate, wherein the first port is connected to the outlet of the condensing pressure regulating valve;

a receiver that connects to the second port of the first valve device via a refrigerant supply line;

an expansion valve that connects to a liquid outlet side of the receiver;

an evaporator that connects to an outlet of the expansion valve and cools the ice-forming mold;

a second valve device that is capable of opening and closing, wherein the second valve device connects between the refrigerant supply line and an inlet side of the evaporator by bypassing the expansion valve via a second bypass line;

a refrigerant return line that is connected to an outlet side of the evaporator;

an accumulator that is connected to the refrigerant return line and is provided between the refrigerant return line and an inlet side of the compressor;

an auxiliary line connecting the third port of the first valve device to the accumulator;

a valve controller that controls the first valve device and the second valve device and comprises:

an ice making function wherein the first valve device connects the first port with the second port so as to connect the condensing pressure regulating valve outlet side to an inlet side of the receiver, and the second valve device is closed, and a de-icing function wherein at a predetermined delay time prior to the ice-making machine switching from the ice making function to a de-icing operation, the first valve device connects the second port with the third port, and at a start of the de-icing operation, the first valve device connects the first port with the second port, and the second valve device is opened.

15. The ice making machine according to claim 14, wherein an inlet of the second bypass line connects to the refrigerant supply line.

16. The ice making machine according to claim 15, wherein the compressor and the condenser are disposed at a distance from the evaporator, and the receiver is disposed close to the evaporator.

17. The ice making machine according to claim 16, wherein the first valve device comprises two two-way valve devices.

* * * * *